United States Patent [19]

Chung

[11] 4,301,926

[45] Nov. 24, 1981

[54] CONTAINER ASSEMBLY FOR LIQUIDS

[75] Inventor: Yun H. Chung, Rossford, Ohio

[73] Assignee: International Automated Machinery, Inc., Perrysburg, Ohio

[21] Appl. No.: 33,899

[22] Filed: Apr. 27, 1979

[51] Int. Cl.[3] ..... B65D 17/28; B65D 39/00

[52] U.S. Cl. ..... 206/620; 222/107; 229/75; 229/DIG. 14

[58] Field of Search ..... 206/620, 629; 229/7 R, 229/7 S, 1.5 B; 222/107; 220/90.2, 90.4, 90.6

[56] References Cited

U.S. PATENT DOCUMENTS

| | | | |
|---|---|---|---|
| 1,213,961 | 1/1917 | Shepard | 220/90.6 X |
| 2,599,919 | 6/1952 | Hucknall | 220/90.6 |
| 2,705,579 | 4/1955 | Mason | 222/107 |
| 2,992,118 | 7/1961 | Daline . | |
| 3,122,297 | 2/1964 | Sachs . | |
| 3,144,976 | 8/1964 | Freshour | 229/7 S |
| 3,349,987 | 10/1967 | Weitzner | 229/7 S X |
| 3,407,969 | 10/1968 | Klein et al. | 229/7 R X |
| 3,462,061 | 8/1969 | Shore | 229/7 |
| 3,486,679 | 12/1969 | Pfahler | 229/7 |
| 3,521,805 | 7/1970 | Ward | 229/7 |
| 3,545,604 | 12/1970 | Gunther | 229/7 |
| 3,558,033 | 1/1971 | Leeds | 220/90.2 |
| 3,635,376 | 1/1972 | Hellstrom | 206/620 X |
| 3,722,754 | 3/1973 | Struble | 229/7 R X |
| 3,799,914 | 3/1974 | Schmit et al. | 426/85 |
| 3,913,734 | 10/1975 | Siegel | 206/498 |
| 4,016,998 | 4/1977 | Finch | 220/90.2 |

FOREIGN PATENT DOCUMENTS

| | | | |
|---|---|---|---|
| 1338614 | 4/1963 | France | 229/7 R |
| 1514427 | 1/1968 | France | 229/7 S |

*Primary Examiner*—Stephen P. Garbe

*Attorney, Agent, or Firm*—Wilson, Fraser, Barker & Clemens

[57] ABSTRACT

A container for liquids formed of a pair of cooperating sheets of plastic material wherein one of the sheets is formed to provide a main liquid containing cavity and a cooperating conduit providing a path for the withdrawal of liquid from the main cavity. The other of the sheets is laminated to the formed sheet so as to hermetically seal the main cavity and the cooperating conduit. A fracturable opening at the outlet of the conduit is provided permitting the withdrawal of liquid therefrom. The formed sheet being formed such that the assembly may be supported, when not in use, to dispose the outlet of the conduit at a higher level than the main cavity to militate against the unintentional spillage of liquid.

4 Claims, 7 Drawing Figures

CONTAINER ASSEMBLY FOR LIQUIDS

BACKGROUND OF THE INVENTION

1. Field of the Invention

The container assembly of the application relates to plastic container assemblies for liquid material, for example, which lend themselves to economical mass production techniques, and may be economically utilized in the beverage industry.

2. Description of the Prior Art

The container industry has been responsible for developing a wide range of plastic containers to accommodate the shipping, storing, displaying and dispensing of a large variety of liquid products, for example.

One area of container design in which considerable attention has been focused is in the field of beverage dispensing structures. Various structures have been developed to facilitate the dispensing of beverages in plastic containers. The structures include features to facilitate the opening of the containers to accomplish the desired dispensing function. Opening structures of the prior art include tear strips, and score lines to facilitate the fracturing of a junction of the container to provide access to the contained liquid. Typical prior art structures are illustrated in the following U.S. Pat. No. 3,215,333 to Stelzer; U.S. Pat. Nos. 3,472,367, 3,472,368, and 3,689,458 to Hellstrom; U.S. Pat. No. 3,913,734 to Siegel; and U.S. Pat. No. 185,299 to O'Connor.

While the containers illustrated and described in the above cited patents successfully accomplished certain of the stated objectives, none of the containers included an efficient, integral, inexpensive and sanitary dispensing structure.

Liquid containers having built-in drinking straws have been developed to provide an efficient and sanitary dispensing structure and are well known in the prior art. Typically, these containers include either a rigid container or a flexible pouch type container. Rigid containers of the carton-type with drinking straws are illustrated in U.S. Pat. No. 3,122,297 to Sachs, U.S. Pat. No. 3,215,329 to Pugh and U.S. Pat. No. 3,486,679 to Pfahler. Such containers are typically formed of a substantially rigid material such as treated paperboard material. The entire drinking straw is disposed within the interior of the container. Flexible containers having drinking straws contained therein are illustrated in U.S. Pat. No. 2,992,118 to Daline and U.S. Pat. No. 3,545,604 to Gunther, Sr. These containers, unlike the rigid containers, when opened, must be supported against a fixed support in order to avoid the spilling of the contents.

The U.S. Pat. No. 3,144,976 to Freshour discloses a container structure designed to overcome the spilling disadvantage of the flexible wall pouch type container. The container includes a substantially rigid supporting frame member for the associated thin flexible material which forms the liquid containing pouch. Further, the pouches of the container include a main compartment for the liquid and a dispensing compartment for housing a drinking straw. The lower portions of the two compartments are in communication through a small restricted aperture which acts to restrict the flow of liquid from the main compartment into the dispensing compartment. When the flexible pouch is laid on its side, liquid must flow through the small restriction in order to spill out of the container. Clearly, the structure does not prevent, but merely restricts, the spillage of the contained liquid.

The U.S. Pat. No. 3,799,914 to Schmit et al discloses a flexible container adopted for storing liquids having flexible side walls and a dispensing member enclosed within the container capable of being unfolded into a dispensing position.

SUMMARY OF THE INVENTION

The container of the present invention abrogates many of the problems and disadvantages of the prior art containers. Further, the present invention is directed to a container formed of plastic material which is easily and economically manufactured and results in a structure which is capable of readily dispensing liquids from the interior thereof through a sanitary spill-proof dispensing structure. The container may be supported with ease on a horizontal surface without any concern of spillage of the contents.

Another object of the invention is to produce a container formed of plastic sheet material which may be mass produced in a continuous fashion enabling selected sections or numbers of the container to be folded upon themselves to enable packaging and marketing thereof in the desired multiples.

Still another object of the invention is to produce a container formed of plastic sheet material formed to provide a main liquid containing cavity and an associated liquid dispensing conduit terminating in a drinking spout.

The above as well as other objects of the invention may be achieved by a liquid filled container assembly comprising a formed sheet of plastic material having relatively flat portions defining an open main liquid containing cavity and a spaced apart adjacent elongate open conduit having one end communicating with the interior of the main cavity and the opposite end terminating in a drinking spout; a sheet of relatively flat plastic material overlaying the formed sheet and being sealed to the flat portions thereof to hermetically seal the main cavity, and the elongate conduit; and weakening means proximate to the spout of the conduit and spaced from the main cavity for facilitating the tearing off of the outermost portion of the sealed sheets to expose the spout to allow liquid to be withdrawn from the main cavity in the conduit.

BRIEF DESCRIPTION OF THE DRAWINGS

The above objects and advantages of the invention, as well as others, will become clearly manifest to those skilled in the art from reading the following detailed description of a preferred embodiment of the invention when considered in the light of the accompanying drawings, in which.

DETAILED DESCRIPTION OF PREFERRED EMBODIMENTS

Figure 1:
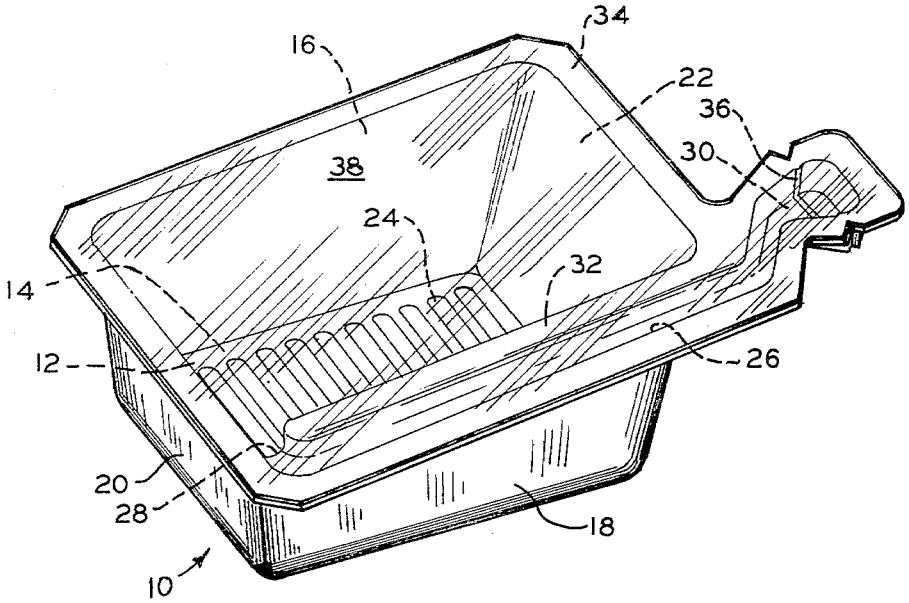
FIG. 1 is a perspective view of a liquid filled container incorporating the features of the present invention.
Figure 2:
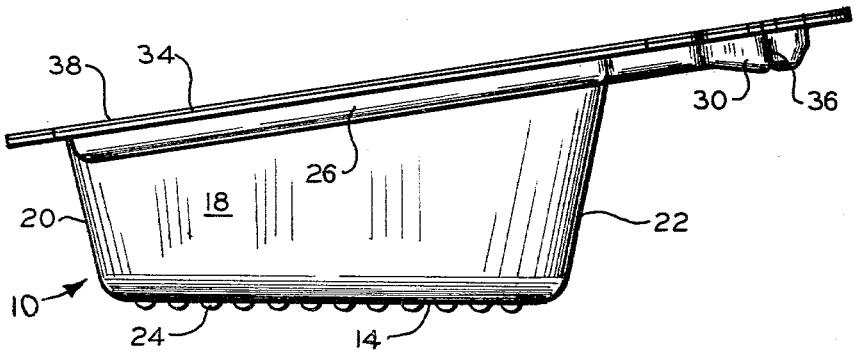
FIG. 2 is a side elevational view of the container illustrated in FIG. 1.

Referring to FIGS. 1 and 2 of the drawings, there is illustrated a container assembly for liquids embodying the novel features of the invention. The container assembly includes a bottom portion formed of a self-supporting plastic material such as polyethylene sheeting for example, which may be vacuum formed to provide a cavity 12 defined by a bottom wall 14, a pair of spaced apart upstanding side walls 16 and 18, and a pair of cooperating spaced apart end walls 20 and 22. The end wall 22 is typically of a greater dimension than the spaced apart end wall 20. The bottom wall 14 may be provided with a plurality of laterally extending strengthening ribs 24.

An elongate conduit 26 is formed to extend in parallel spaced relation from the side wall 18 and has one end thereof in communication with the cavity 12 through an opening 28 typically formed near the junction of the end wall 20 and the side wall 18. The opposite end of the elongate conduit 26 terminates in a drinking spout portion 30, which extends outwardly from the end wall 22. It will be appreciated that the cavity 12 and the elongate conduit 26 are spaced apart from one another by a flat zone or land 32, which extends from the opening 28 and terminates in the region of the junction between the end wall 22 and the associated side wall 18.

A planar flange 34 extends completely around the peripheral portions of the bottom portion 10 as is clearly apparent in FIG. 1.

Adjacent the outermost end of the spout 30 of the conduit 26 is a weakening line 36 which will be explained in more detail hereinafter.

The above described bottom portion 10 is then covered by a flexible sheet of film material 38 and typically sealed to the flat zone 32 and the peripheral planar flange 34. Typically, the film 38 is applied to the bottom portion simultaneously with the filling operation of the liquid to be contained within the container assembly. In the preferred operation, applying the covering film 38 to the bottom portion 10 is accomplished during the time that the bottom portion is disposed in such a fashion that the spout 30 is in an elevated position. Initially, the covering film is typically applied to the portion of the planar flange 34 adjacent the end wall 20 and the portions of the flange 34 adjacent the adjoining edges of the side walls 16 and 18 and the associated end wall 20. After the covering film 38 is initially sealed to the planar flange 34 as mentioned above, the liquid to be contained is introduced into the cavity 12 and simultaneously the covering film 38 is continuously applied, and the liquid introducing nozzle means, for example, is removed prior to the instant that the covering film 38 is disposed completely over the bottom portion 10. During the aforementioned operation, the covering film 38 is suitably sealed to the facing surfaces of the flat zone 32 and the planar flange 34 to hermetically seal the container. The sealing operation may be accomplished by a heating operation in the event the bottom portion 10 and the covering film 38 are formed of a thermoplastic material. Manifestly, the sealing may also satisfactorily be achieved by using suitable adhesive materials.

The filled and sealed container assembly may then be stored or transported to a point of sale. The liquid contained within the container assembly may be withdrawn by holding the container assembly in a position where the spout 30 is in an elevated position and the outer end thereof grasped to bend the uppermost end thereof about the weakening line 36 so that the end may be removed and the contents withdrawn from the then opened spout 30. It will be appreciated that the liquid contained within the container assembly illustrated in FIGS. 1 and 2 may be readily withdrawn from the interior of the cavity 12 through the conduit 26 by utilizing the opened spout 30 as a drinking straw. The material defining the cavity 12 is of sufficient flexibility to allow the withdrawal of liquid within the cavity 12 without providing an ancillary air opening to avoid the formation of a vacuum in the cavity 12, which might otherwise prevent the withdrawal of liquid. At the end of one sipping operation the walls defining the cavity 12 may be flexed inwardly and then air is admitted through the open spout 30, the conduit 26, the opening 28, and thence into the cavity 12.

Also, it will be appreciated that when the user wishes to place the container assembly at rest, the bottom wall 14 is dsposed on a supporting surface. Since the end wall 22 is of greater height than the spaced end wall 20, the spout portion 30 is elevated, thereby preventing the spillage of any liquid from the interior of the assembly.

Figure 3:
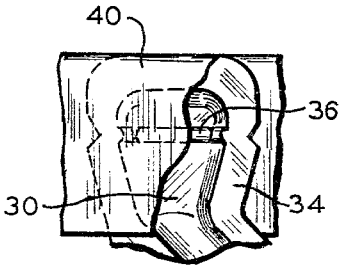
FIG. 3 is an enlarged fragmentary view of the drinking spout structure of the container illustrated in FIGS. 1 and 2.
Figure 4:
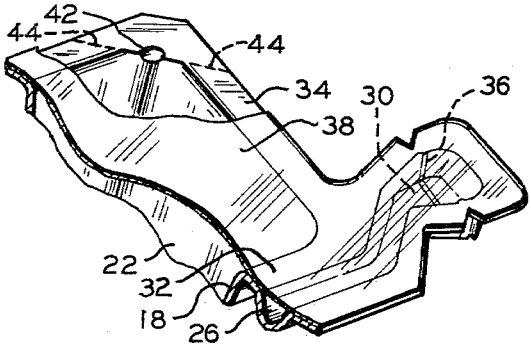
FIG. 4 is an enlarged fragmentary view of a modified form of the container illustrated in FIGS. 1 and 2.

FIG. 3 illustrates a modified version of the spout 30 of the container assembly illustrated in FIGS. 1 and 2 wherein an outer wrap 40 is employed to maintain the end of the spout 30, and especially the portion used as a straw to withdraw the contents, in a sanitary state. The wrap 40 is typically a transparent, flexible plastic film. The outer wrap 40 is generally sealed to the outermost portion of the spout 30 adjacent the portion of the peripheral flange 34, which is removed prior to dispensing the liquid within the container assembly and extends inwardly to the junction of the spout 30 and the remainder of the bottom portion 10. This arrangement provides for the covering of substantially the entire length of the spout 30 during storage or shipment.

In the event the material used in fabricating the container assembly described in connection with the illustrations of FIGS. 1 and 2 have such inherent rigidity to militate against inward flexure thereof during the dispensing liquid within the container assembly, it may be necessary to employ an air hole 42, which may be opened by grasping the end of the flange 34 and flexing the same about the weakening line 44. Thereby the interior of the cavity 12 is in communication with the atmosphere to prevent the formation of a vacuum therein.

Figure 5:
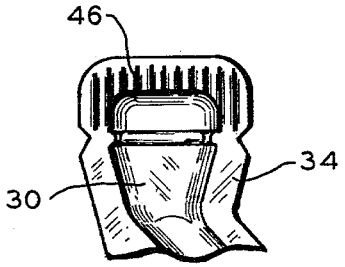
FIG. 5 is an enlarged fragmentary view of a modified form of the dispensing spout of the embodiment illustrated in FIGS. 1 and 2.
Figure 6:
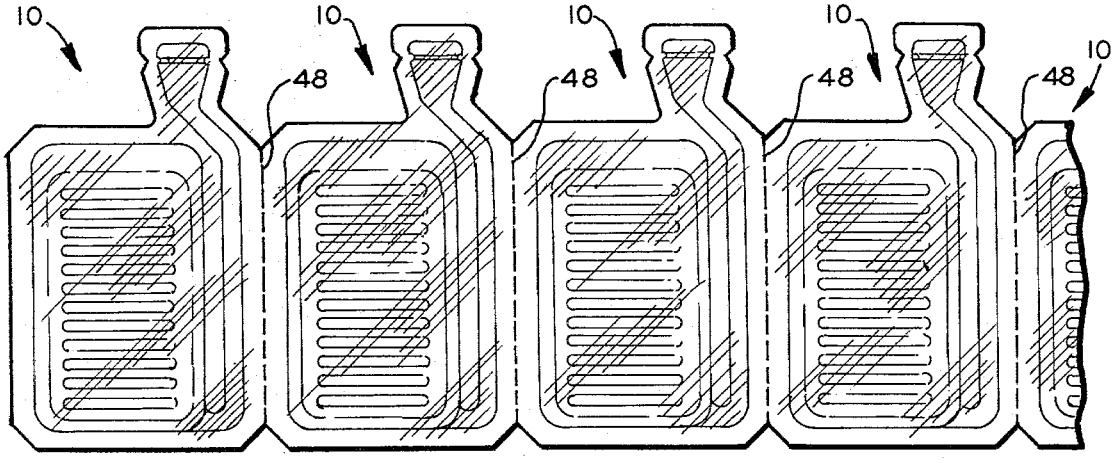
FIG. 6 is a view of a continuous section of a number of liquid filled containers incorporating the features of the invention.
Figure 7:
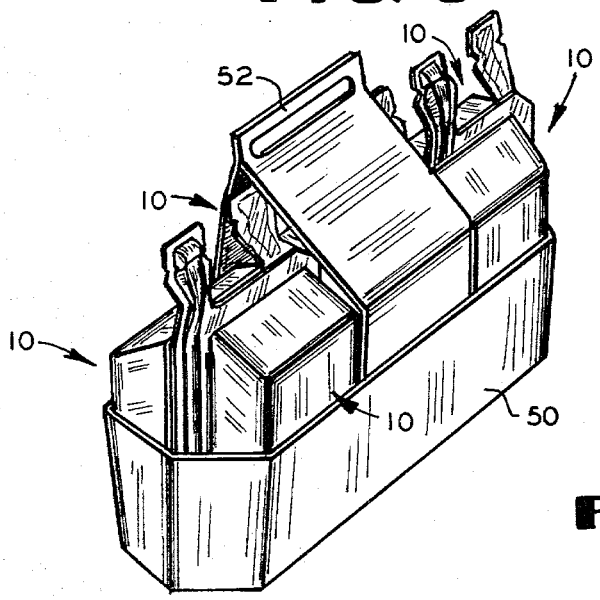
FIG. 7 is a perspective view of the strip of containers illustrated in FIG. 6 after a number of containers have been folded upon a like number of containers and banded together for display and transit to the point of sale.

FIG. 5 illustrates a further embodiment to the flange 34 adjacent the outermost end of the spout 30, wherein a plurality of strengthening ribs 46 are employed in the zone to be removed upon the opening of the associated container assembly.

Typically, the container assembly may be formed on a drum wherein a series of six, for example, bottom portions 10 may be formed in side-by-side relationship and joined together by spaced apart weakening lines 48. In such instances two or three of the aligned container assemblies, after being filled with the desired liquid and sealed, may be folded upon themselves and held in such condition by a paper board carrying case 50, having a handle 52.

In certain instances, the bottom portion 10 may be fabricated from a rather flexible sheet of material rather than the more dimensionally stable sheet stock as described above. By carefully controlling the rigidity of the resultant laminate formed around the peripheral portion of the container assembly in the regions where the stock forming the bottom portion 10 and the overlaying sheets 38 are sealed together, a container assembly of the above type may be formed. Among the obvious advantages of such a construction is the capability of the walls defining the liquid containing cavity to flex inwardly during withdrawal of the contained liquid, while simultaneously being self supporting so as to militate against liquid leaking out of the open spout 30 during periods that the container assembly is rested on a horizontal supporting surface.

In accordance with the provisions of the patent statutes, I have explained the principle and mode of operation of the invention, and have illustrated and described what I consider to be its best embodiments. It is understood that, within the scope of the appended claims, the invention may be practiced otherwise than as specifically illustrated and described.

What I claim is:

1. A liquid filled container assembly comprising:

a formed sheet of plastic material having relatively flat portions defining an open main liquid containing cavity and a spaced apart adjacent elongate open conduit having one end communicating with the interior of the main cavity, the opposite outer end of the open conduit terminating in a drinking spout, the main cavity including a bottom wall having a relatively flat surface for supporting said container assembly in periods of non-use whereby the drinking spout terminates at a level above the highest point of the cavity;

a sheet of relatively flat plastic material overlaying said formed sheet and being sealed to the flat portions thereof to hermetically seal the main cavity, the elongate conduit, and the spout; and weakening means proximate the spout of the conduit and spaced from the cavity for facilitating the tearing off of the portion of the sealed sheets defining the outer end of the conduit to expose the spout to allow liquid to be withdrawn from the main cavity and the conduit.

2. The invention defined in claim 1 wherein the main liquid containing cavity of said formed sheet is defined by a pair of spaced apart side walls, spaced apart end walls, and said bottom wall, said side walls and said end walls extending approximately perpendicularly from the bottom wall, and one of said end walls extending a greater distance than the opposing end wall.

3. The invention defined in claim 2 wherein the opposite outer end of said conduit terminating in a drinking spout extends outwardly of the main cavity adjacent said one of said end walls.

4. The invention defined in claim 2 wherein said drinking spout is covered by a protective outer wrap.

* * * * *